US008757618B2

(12) United States Patent
Matsumoto

(10) Patent No.: US 8,757,618 B2
(45) Date of Patent: Jun. 24, 2014

(54) RECORDING MEDIUM CONVEYING APPARATUS AND IMAGE FORMING APPARATUS

(71) Applicant: KYOCERA Document Solutions Inc., Osaka (JP)

(72) Inventor: Yasutaka Matsumoto, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 13/960,331

(22) Filed: Aug. 6, 2013

(65) Prior Publication Data

US 2014/0042692 A1 Feb. 13, 2014

(30) Foreign Application Priority Data

Aug. 9, 2012 (JP) ..... 2012-177606

(51) Int. Cl.
*B65H 7/02* (2006.01)

(52) U.S. Cl.
USPC ..... 271/265.02; 271/264; 271/265.01

(58) Field of Classification Search
USPC ..... 271/264, 265.01, 265.02
See application file for complete search history.

(56) References Cited

U.S. PATENT DOCUMENTS 6,023,034 A * 2/2000 Nakajima et al. ..... 209/584
6,792,332 B1 * 9/2004 DePoi ..... 700/213
7,068,969 B2 * 6/2006 Ueda ..... 399/388
8,561,984 B2 * 10/2013 Mitsuya et al. ..... 271/265.01

FOREIGN PATENT DOCUMENTS

JP 2000-191230 A 7/2000

* cited by examiner

*Primary Examiner* — Michael McCullough
*Assistant Examiner* — Howard Sanders
(74) *Attorney, Agent, or Firm* — Knobbe, Martens Olson & Bear LLP

(57) ABSTRACT

A recording medium conveying apparatus includes a conveying path, a conveying section, recording medium detection sensors, a medium interval calculation section, a control section, and a difference calculation section. The difference calculation section sets a medium interval based on an output from the recording medium detection sensor serving as a reference sensor to a reference value and calculates a difference by subtracting a medium interval based on the output from each of the other recording medium detection sensors from the reference value. When, during the continuous conveyance of recording media, a value obtained by subtracting the difference from the medium interval based on the output from any of the other recording medium detection sensors is equal to or less than zero, the control section controls the conveying section to extend the medium interval.

7 Claims, 6 Drawing Sheets

RECORDING MEDIUM CONVEYING APPARATUS AND IMAGE FORMING APPARATUS

INCORPORATION BY REFERENCE

This application claims priority to Japanese Patent Application No. 2012-177606 filed on 9 Aug. 2012, the entire contents of which are incorporated by reference herein.

BACKGROUND

The present disclosure relates to a recording medium conveying apparatus and an image forming apparatus, and more particularly, to a technique of continuously conveying a plurality of recording media at the time of continuous printing.

An image forming apparatus for performing continuous printing by continuously conveying a plurality of recording sheets toward an image forming section has been known. In order to perform conveying control to maintain a constant interval (hereinafter referred to as a sheet interval) between respective recording sheets in a conveying direction of the recording sheets, the image forming apparatus includes a plurality of recording sheet detection sensors disposed on a conveying path on which the recording sheets are conveyed, at different positions in the conveying direction thereof. Each recording sheet detection sensor outputs a detection signal representing whether the recording sheets are present at each disposition position thereof and a control section of the image forming apparatus calculates the sheet interval of each recording sheet conveyed on the conveying path based on a detection signal output by each recording sheet detection sensor and conveys the recording sheet by controlling driving of a conveying section of the recording sheet so that the sheet interval becomes a predetermined interval. As such, an example of the image forming apparatus including the recording sheet detection sensor may include an apparatus for preventing misdetection of paper clogging due to factors such as detection errors by each recording sheet detection sensor, and the like.

SUMMARY

As an aspect of the present disclosure, a technique of further improving the above-described related art is proposed.

According to an aspect of the present disclosure, there is provided a recording medium conveying apparatus including: a conveying path, a conveying section, a recording medium detection sensor, a medium interval calculation section, a control section, and a difference calculation section.

A recording medium is conveyed through the conveying path.

The conveying section continuously conveys the plurality of recording media through the conveying path.

The plurality of recording medium detection sensors are disposed in the conveying path at different positions in a conveying direction of the recording medium to detect the recording medium at each of the positions where the recording medium detection sensors are disposed.

The medium interval calculation section calculates, for each recording medium detection sensor, a medium interval in the conveying direction of recording media continuously conveyed on the conveying path by the conveying section based on outputs from the plurality of recording medium detection sensors.

The control section controls the conveyance of the recording medium by the conveying section based on the medium interval calculated for each recording medium detection sensor by the medium interval calculation section.

The difference calculation section sets the medium interval calculated by the medium interval calculation section based on an output from the recording medium detection sensor serving as a reference sensor among the plurality of recording medium detection sensors to a reference value and calculates at a predetermined time a difference by subtracting a medium interval calculated by the medium interval calculation section based on an output from each of the other recording medium detection sensors from the reference value.

When, during the continuous conveyance of the recording media by the conveying section, a value obtained by subtracting the difference calculated by the difference calculation section from the medium interval between recording media calculated by the medium interval calculation section based on the output from the reference sensor is equal to or less than zero, the control section controls the conveying section to convey each recording medium by extending the medium interval by a predetermined value.

DETAILED DESCRIPTION

Figure 1:
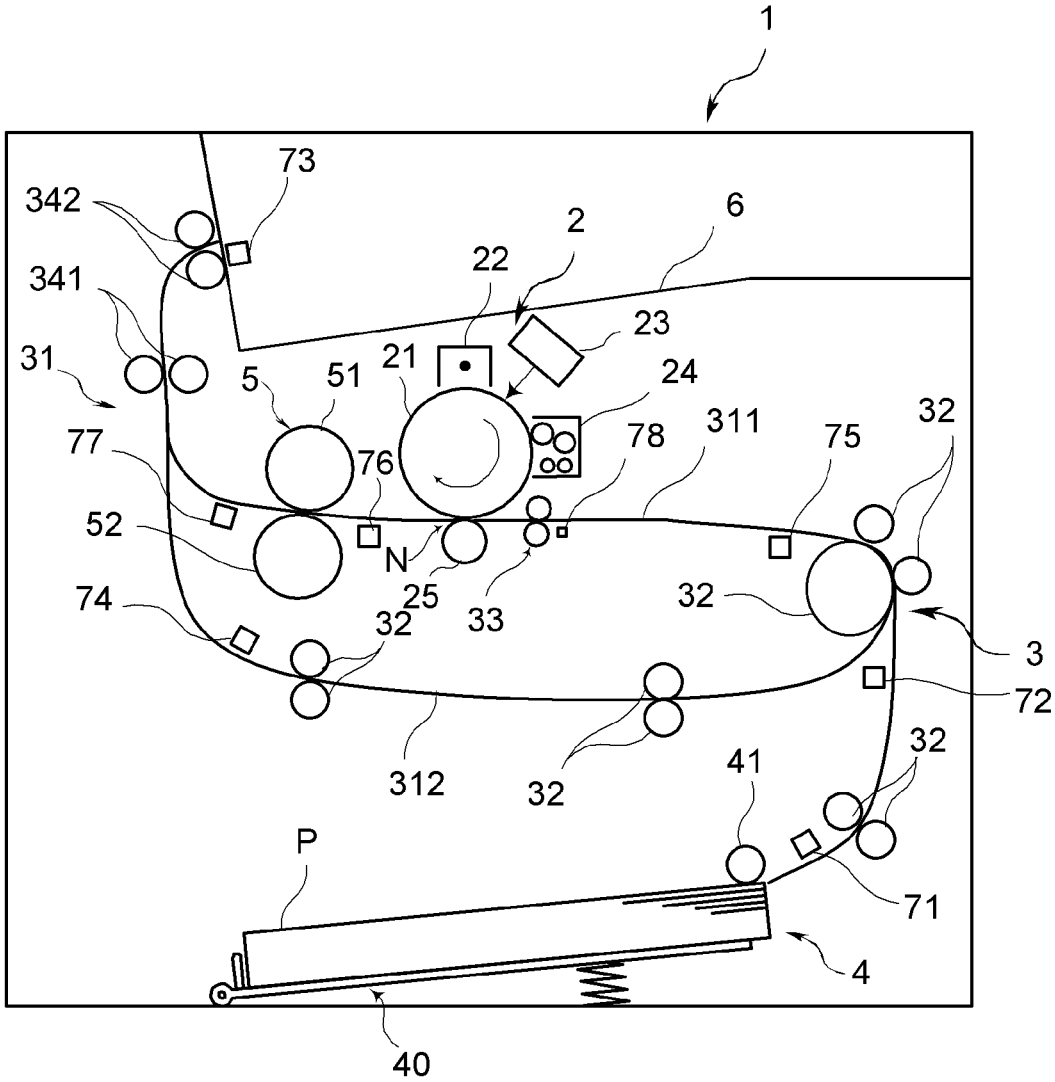
FIG. 1 is a view showing a configuration of an image forming apparatus according to an embodiment of the present disclosure.
Figure 2:
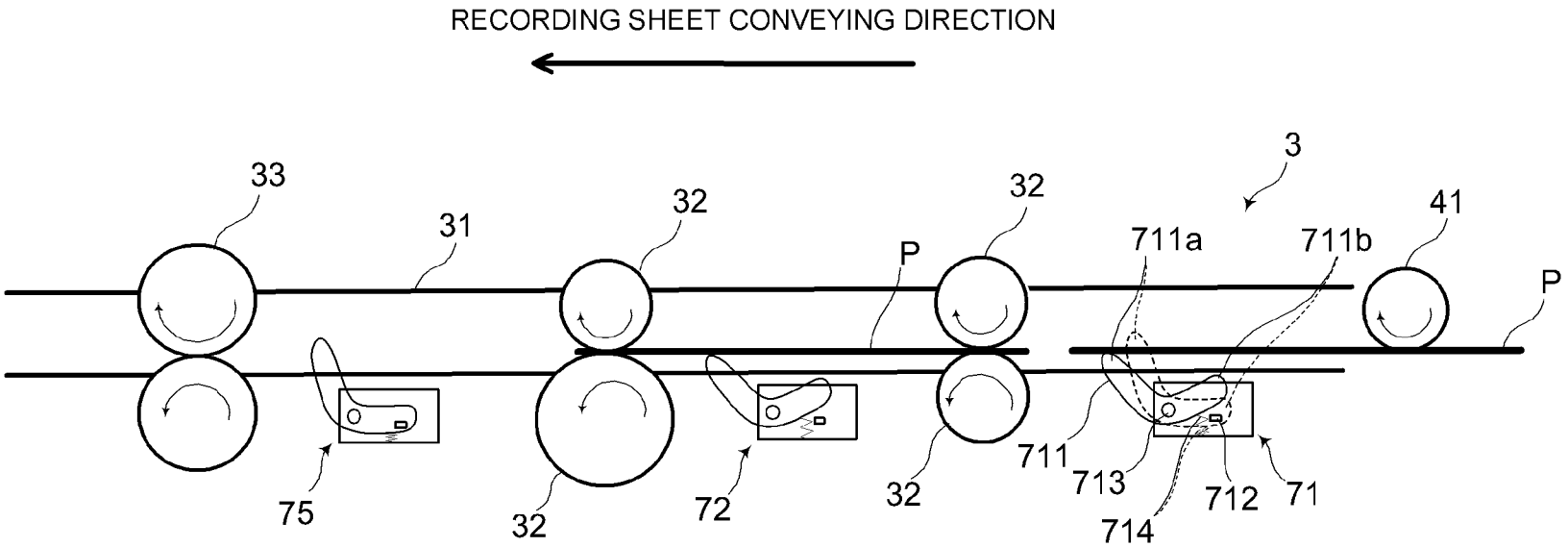
FIG. 2 is a view showing positions where recording sheet detection sensors are disposed and a configuration in the vicinity of the positions in a conveying path.

Hereinafter, a recording medium conveying apparatus and an image forming apparatus according to an embodiment of the present disclosure will be described with reference to the accompanying drawings. FIG. 1 is a view showing a configuration of an image forming apparatus 1 according to the embodiment of the present disclosure. FIG. 2 is a view showing positions where recording sheet detection sensors are disposed and a configuration in the vicinity of the positions in a conveying path.

The image forming apparatus 1 includes an image forming section 2, a conveying section 3, a paper feeding mechanism 4, a fixing section 5, and a discharge tray 6. In this embodiment, a case in which the image forming apparatus 1 is a printer is described by way of example.

The image forming section 2 performs an image forming operation of forming a toner image on a recording sheet P (an example of a recording medium) conveyed from the paper feeding mechanism 4 by the conveying section 3. The image forming section 2 includes a photosensitive drum 21, a charging section 22, an exposing section 23, a developing section 24, and a transfer roller 25.

The photosensitive drum 21 has a photosensitive layer formed on a surface thereof and is charged by the charging section 22 to set a surface potential thereof to a predetermined value.

The charging section 22 is disposed at a position facing the surface of the photosensitive drum 21. The charging section 22 charges a circumferential surface of the photosensitive drum 21 rotating in an arrow direction illustrated in FIG. 1 substantially uniformly by predetermined charging capacity.

The exposing section 23 is disposed at a position facing the surface of the photosensitive drum 21, and disposed downstream from the charging section 22 in the rotation direction of the circumferential surface of the photosensitive drum 21. The exposing section 23 irradiates the circumferential surface of the charged photosensitive drum 21 with laser light illustrated by an arrow in FIG. 1 corresponding to image data or the like input from a computer (not illustrated) network-connected to the image forming apparatus 1 and forms an electrostatic latent image corresponding to the image data on the circumferential surface of the photosensitive drum 21. The exposing section 23, which is a laser exposing section, includes a laser light source (not illustrated) outputting a laser beam, a polygon mirror (not illustrated) reflecting the laser beam to the surface of the photosensitive drum 21, and optical components such as a lens (not illustrated) and a mirror (not illustrated) for inducing the laser light reflected by the polygon mirror to the photosensitive drum 21. Meanwhile, the exposing section 23 may use other methods such as a method of irradiating the surface of the photosensitive drum 21 with a light emitting diode (LED).

The developing section 24 supplies toner (not illustrated) to the electrostatic latent image formed on the surface of the photosensitive drum 21 by the exposing section 23. The toner supplied by the developing section 24 is attached to the exposed portion on the surface of the photosensitive drum 21 by the exposing section 23 to form the toner image according to the electrostatic latent image on the surface of the photosensitive drum 21. The toner is supplied to the developing section 24 from a toner container (not illustrated).

The transfer roller 25 is disposed at a position facing the photosensitive drum 21, and disposed downstream from the developing section 24 in the rotation direction of the photosensitive drum 21. A transfer bias having an opposite polarity to a charged polarity of the toner is applied to the transfer roller 25 by a transfer bias applying mechanism (not illustrated). Therefore, the transfer roller 25 transfers the toner image formed on the surface of the photosensitive drum 21 onto the recording sheet P conveyed to a toner image transfer position N, in a nip portion (hereinafter referred to as a transfer position N of the toner image) between the photosensitive drum 21 and the transfer roller 25.

The fixing section 5 is disposed downstream in a conveying direction of the recording sheet P from the toner image transfer position N of the toner image to recording sheet P by the image forming section 2 and fixes the toner image transferred on the recording sheet P passing through the image forming section 2 by allowing a heating roller 51 and a pressing roller 52 to thermal compress the toner image. Meanwhile, the heating roller 51 and the pressing roller 52 are rotatably driven by a rotation driving force transmitted from a drive section 9 (see FIG. 3) to be described later.

A paper conveying mechanism (a conveying section) 3 includes a conveying path 31, pairs of conveying rollers 32, a pair of registration rollers 33, and pairs of switch back rollers 341 and 342. Meanwhile, the pairs of conveying rollers 32, the pair of registration rollers 33, and the pairs of switch back rollers 341 and 342 are rotatably driven by the rotation driving force transmitted from the drive section 9.

The conveying path 31 is a conveying path on which the recording sheet P is conveyed from the paper feeding mechanism 4 to the discharge tray 6 via the image forming section 2 and the fixing section 5. The conveying path 31 is provided with the pairs of conveying rollers 32 at several positions and the recording sheet P is conveyed from the paper feeding mechanism 4 to the image forming section 2, the fixing section 5, and the discharge tray 6 through the conveying path 31, through the nip of the pair of rollers by the rotation of the pair of conveying rollers 32.

Further, the conveying path 31 has a main conveying path 311 and a reverse conveying path 312. The main conveying path 311 is a conveying path connecting from the paper feeding mechanism 4 to the image forming section 2, the fixing section 5, and the discharge tray 6. The reverse conveying path 312 is a conveying path for again conveying the recording sheet P, on one surface of which an image has been formed, to the image forming section 2 to perform double-sided printing, in the image forming section 2. The reverse conveying path 312 is branched from the main conveying path 311 at a downstream side in the conveying direction of the recording sheet P from the fixing section 5, in the main conveying path 311 and is joined with the main conveying path 311 at a position downstream from the paper feeding mechanism 4 and upstream from the image forming section 2, in the conveying direction of the recording sheet P.

The pairs of switch back rollers 341 and 342 are disposed between the fixing section 5 and the discharge tray 6 in the main conveying path 311. The pairs of switch back rollers 341 and 342 convey the recording sheet P between the fixing section 5 and the discharge tray 6 under the control of the control section 100 (FIG. 3) to be described later. When the pairs of switch back rollers 341 and 342 discharge the recording sheet P passing through the image forming section 2 and the fixing section 5 to the discharge tray 6, the pairs of switch back rollers 341 and 342 convey the recording sheet P to the discharge tray 6 until a rear edge of the recording sheet P is separated from the pair of switch back rollers 342 on the downstream side in the conveying direction of the recording sheet P.

Meanwhile, when the pairs of switch back rollers 341 and 342 again convey the recording sheet P passing through the image forming section 2 and the fixing section 5 to the image forming section 2 for double-sided printing, the pairs of switch back rollers 341 and 342 first convey the recording sheet P passing through the fixing section 5 toward the discharge tray 6. Further, when the rear edge of the recording sheet P in the conveying direction is separated from the pair of switch back rollers 341 on an upstream side in the conveying direction of the recording sheet P and the recording sheet P is sandwiched between the pair of switch back rollers 342 on the downstream side in the conveying direction of the recording sheet P, the pairs of switch back rollers 341 and 342 reversely rotate by the control of the control section 100. In this case, the recording sheet P is guided to the reverse conveying path 312 by a conveying path switching mechanism (not illustrated) which is disposed at a branch point of the main conveying path 311 and the reverse conveying path 312.

By doing so, the recording sheet P reversely conveyed through the main conveying path 311 by the pairs of switch back rollers 341 and 342 is guided to the reverse conveying path 312, and thus is conveyed to a portion of the main conveying path 311 which is upstream in the conveying direction of the recording sheet P from the image forming section 2 and is again conveyed from the portion to the image forming section 2.

At the time of the re-conveying, since a surface of the recording sheet P opposite to the surface on which an image has been already formed faces the photosensitive drum 21 by an reverse operation by the pairs of switch back rollers 341 and 342 and the conveying operation of the recording sheet P in the reverse conveying path 312, an image is formed on the other surface different from the surface on which an image was previously formed by the image forming section 2.

The pair of registration rollers 33 are disposed upstream in the conveying direction of the recording sheet P from the image forming section 2 in the main conveying path 311, and adjust a timing of conveying the recording sheet P conveyed through the main conveying path 311 to a position at which the photosensitive drum 21 and the transfer roller 25 face each other, that is, the toner image transfer position N by the image forming section 2.

Further, the conveying path 31 is provided with paper detection sensors 71, 72, 73, 74, 75, 76, and 77 at several positions. The paper detection sensors 71 to 77 and a registration sensor 78 are, for example, actuator sensors. Meanwhile, the paper detection sensors 71, 72, and 75 are an example of a recording medium detection sensor in the claims.

A configuration of the paper detection sensors 71 to 77 and the registration sensor 78 will be described. Since the configurations of the sensor are the same, the paper detection sensor 71 will be described by way of example.

As illustrated in FIG. 2, the paper detection sensor 71 includes an actuator 711 pivoting by the pressing of the recording sheet P and a photo sensor 712 including a light emitting part and a light receiving part mounted at positions at which they face each other, to allow a rear end part 711*b* of the actuator 711 to be inserted there between, in a direction orthogonal to the conveying direction of the recording sheet.

The actuator 711 is configured to pivot around a rotating shaft 713 and the rear end part 711*b* thereof is pulled in an arrow direction illustrated in FIG. 2 by a tension spring 714 so that, as illustrated by a broken line in FIG. 2, a front end part 711*a* thereof protrudes into the conveying path 31 as far as a position where it contact the recording sheet P conveyed on the conveying path 31. Further, in this state, the position of the rear end part 711*b* is set so as to be positioned to block the reception of light, which is emitted from the light emitting part, by the light receiving part of the photo sensor 712. In this case, the recording sheet P is not on the conveying path 31, the light receiving part of the photo sensor 712 does not receive the light from the light emitting part in the state in which the front end part 711*a* of the actuator 711 is not pressed by the recording sheet P, and a no-paper signal (off signal) representing that the recording sheet P is not present at the position, where the paper detection sensor 71 is disposed, is output to the control section 100.

Further, when the recording sheet P is present on the position, where the paper detection sensor 71 is disposed, on the conveying path 31, and the actuator 711 pivots around the rotating shaft 713 as a pivoting center by allowing the recording sheet P to press the front end part 711*a* of the actuator 711, the rear end part 711*b* moves to a position not to block the reception of the light, which is emitted from the light emitting part, by the light receiving part of the photo sensor 712, as illustrated in a solid line in FIG. 2. In this case, the recording sheet P is on the conveying path 31, the light receiving part of the photo sensor 712 receives the light from the light emitting part in a state in which the front end part 711*a* of the actuator 711 is pressed by the recording sheet P, and a paper signal (on signal) representing that the recording sheet P is present at the disposition position of the paper detection sensor 71 is output to the control section 100.

Further, configuring the paper detection sensors 71 to 77 and the registration sensor 78 as sensors having actuators is merely an example and each sensor may be configured as another type of sensor.

The disposition of each paper detection sensor will be described. For example, the paper detection sensor 71 is disposed at a position between a paper feeding roller 41 (to be described later) in the main conveying path 311 and the pair of conveying rollers 32 disposed on a most upstream side in the conveying direction of the recording sheet P as seen from the paper feeding roller 41 in FIG. 1.

The paper detection sensor 72 is disposed at a position between the pair of conveying rollers 32 disposed on the most upstream side and the pair of conveying rollers 32 disposed on a second upstream side in the conveying direction of the recording sheet P as seen from the paper feeding roller 41.

The paper detection sensor 75 is disposed at a position on the main conveying path 311 which is between the pair of conveying rollers 32 disposed on the second upstream side and the pair of registration rollers 33.

Next, the paper detection sensor 73 is disposed at the rear end of the main conveying path 311 which is further downstream in the conveying direction of the recording sheet P from the paper detection sensor 72, that is, at a connection portion between the main conveying path 311 and the discharge tray 6. In addition, the paper detection sensor 74 is disposed on the reverse conveying path 312. Further, the paper detection sensor 76 is disposed between the toner image transfer position N and the fixing section 5 in the main conveying path 311. The paper detection sensor 77 is disposed between the fixing section 5 and the pair of switch back rollers 341 in the main conveying path 311.

Further, the registration sensor 78 is disposed upstream in the conveying direction of the recording sheet P from the pair of registration rollers 33 and is disposed downstream in the conveying direction of the recording sheet P from the paper detection sensor 72 in the main conveying path 311.

The control section 100 uses the timing at which a front edge of the recording sheet P is detected by the paper detection sensor 71 to control the timing at which the recording sheet P reaches the transfer position N of the image forming section 2 so that the recording sheet P reaches the transfer position N where a toner image is transferred by the image forming section 2, after a predetermined time (defined based on a paper conveying speed by the pair of registration rollers 33 and a distance between the registration sensor 78 and the transfer position N where a toner image is transferred) elapses from the timing, or the like thereby performing control to match a toner image transfer timing onto the recording sheet P by the image forming section 2 with the timing when the recording sheet P reaches the transfer position N.

The control section 100 determines whether paper is jammed (jamming of the recording sheet P) in the conveying path 31, based on the paper signal and the no-paper signal obtained from each paper detection sensor 71 to 77. For example, the control section 100 detects the front edge of the recording sheet P based on the paper signal and the no-paper signal from the paper detection sensor 71 and then determines that paper is jammed when the rear edge of the recording sheet P is not detected after the predetermined time (defined based on the conveying speed of the recording sheet P by the pair of conveying rollers 32 and the length of the recording sheet P in the conveying direction of the recording sheet P) has elapsed. The paper detection sensors 72 to 77 are same as above.

Further, the control section 100 detects that the rear edge of the recording sheet P is separated from the pair of switch back rollers 342 based on the timing at which the passage of the rear edge of the recording sheet P is detected by using the paper detection sensor 73.

The paper feeding mechanism 4 is a mechanism for feeding the recording sheet P to the conveying path 31 and includes a paper feeding cassette 40 and a paper feeding roller 41. The paper feeding cassette 40 houses a plurality of recording sheets P in the state in which the recording sheets P are laminated by being stacked. The paper feeding roller 41 contacts the top recording sheet P among the recording sheets P housed in the paper feeding cassette 40 and picks up the recording sheets P one by one from the paper feeding cassette 40 by the rotation of the paper feeding roller 41 and feeds the picked up recording sheet P to the conveying path 31 (the main conveying path 311).

Figure 3:
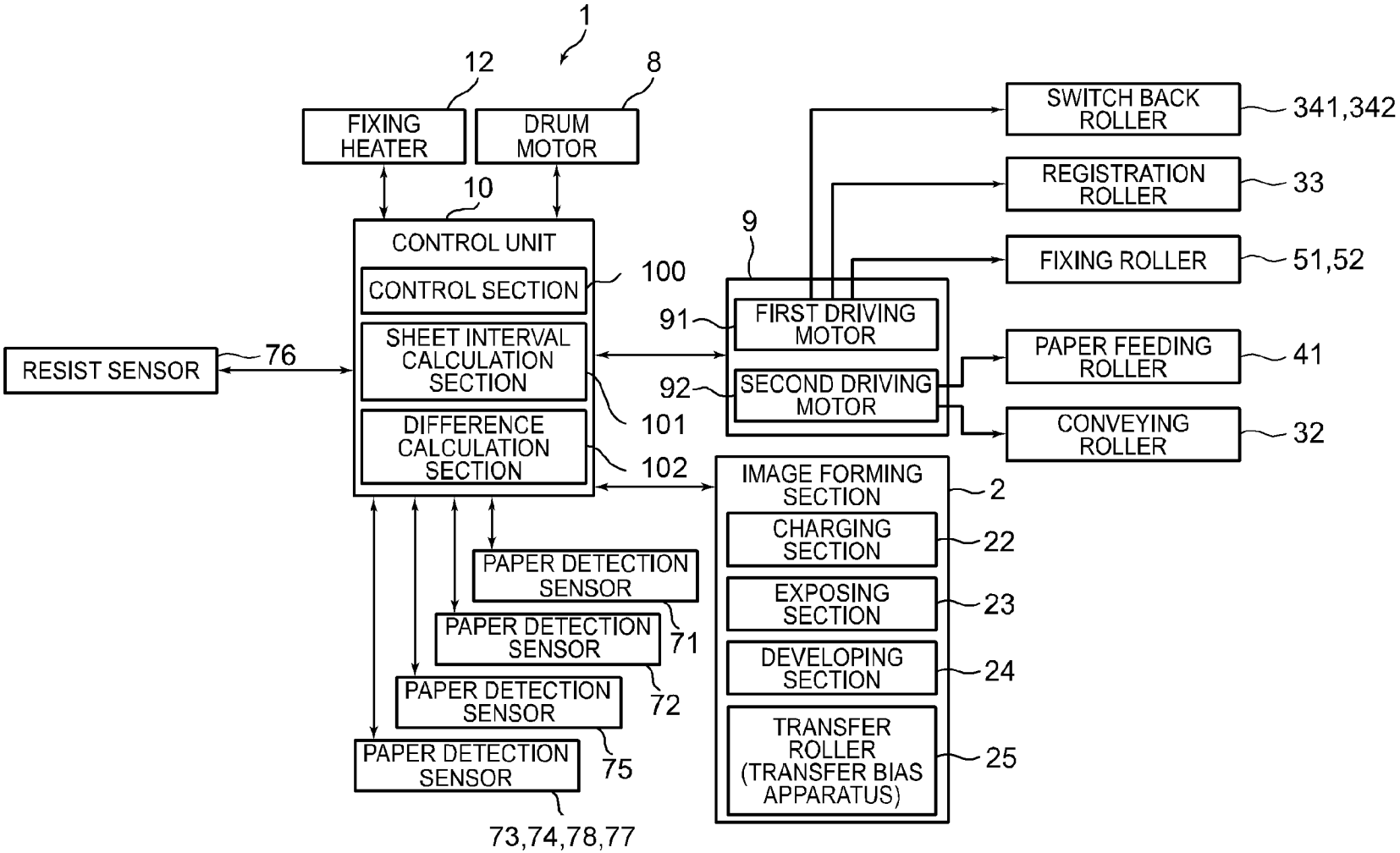
FIG. 3 is a block diagram showing an electrical configuration of the image forming apparatus.

FIG. 3 is a block diagram illustrating an electrical configuration of the image forming apparatus 1.

First, the electrical configuration of the image forming apparatus 1 will be described.

The image forming apparatus 1 includes a control unit 10 composed of a CPU, a ROM, a RAM, and the like. The control unit 10 includes a control section 100, a sheet interval calculation section 101, and a difference calculation section 102.

The control section 100 serves to control the overall operation of the image forming apparatus 1 and mainly controls the driving of the image forming section 2, a drum motor 8, and the drive section 9, and a fixing heater 12.

The sheet interval calculation section (a medium interval calculation section) 101 calculates the sheet interval in the conveying direction of the recording sheet P between recording sheets P which are continuously conveyed on the conveying path 31 by the conveying section 3, based on the detection signal including the paper signal and the no-paper signal output from the paper detection sensors 71, 72, and 75. That is, the sheet interval calculation section 101 calculates a period of time from the time point at which the detection signals received from the paper detection sensors 71, 72, and 75 are changed from the paper signal to the no-paper signal to the time point at which the detection signals are changed from the no-paper signal to the paper signal, as the sheet interval (the medium interval: unit (ms)) to the front edge of the next continuously conveyed recording sheet P from the rear edge of the previously conveyed recording sheet P in the disposition positions of the paper detection sensors. The sheet interval calculation section 101 calculates the sheet interval based on the detection signal output from each of the detection sensors 71, 72, and 75. The control section 100 controls the conveyance of the recording sheet P by the conveying section 3 based on the sheet interval calculated by the sheet interval calculation section 101.

The difference calculation section 102 uses the paper detection sensor 71 as a reference sensor and uses the sheet interval calculated by the sheet interval calculation section 101 based on the detection signal output from the reference sensor 71 as a reference value to calculate a difference between the sheet interval calculated by the sheet interval calculation section 101 based on the detection signals output from the paper detection sensors 72 and 75 and the reference value at a predetermined time. In this embodiment, the difference calculation section 102 sets a difference obtained by subtracting the sheet interval calculated by the sheet interval calculation section 101 from the reference value as the difference. The predetermined time corresponds to a time of conveying first and second recording sheets in, for example, continuous printing among printing jobs. Further, in this embodiment, the predetermined time is described as the time when the first and second recording sheets are conveyed, but the predetermined time is not limited to this time.

When, during the continuous conveyance of the recording sheets P by the conveying section 3, the sheet interval between each pair of adjacent recording sheets P calculated by the sheet interval calculation section 101 based on the output from the reference sensor 71 is equal to or less than a difference calculated by the difference calculation section 102, i.e., when a value obtained by subtracting the difference from the sheet interval is equal to or less than zero, the control section 100 controls the conveying section 3 to convey each recording sheet P by extending the medium interval by a predetermined value.

Further, the reference sensor is not limited to the paper detection sensor 71, and may be any of the paper detection sensors 72 and 75.

However, when the reference sensor is the paper detection sensor 71 disposed at the most upstream position in the conveying direction of the recording sheet P, other paper detection sensors 72 and 75 disposed downstream from the paper detection sensor 71 may be controlled using the detection result of the sheet interval by the reference sensor to extend the sheet interval based on the difference. As a result, the sheet interval between the respective continuously conveyed recording sheets P can be more accurately adjusted.

The drive section 9 includes a first driving motor 91 and a second driving motor 92. The first driving motor 91 is a driving source configured to supply a rotation driving force to the pairs of conveying rollers 32 disposed downstream in the conveying direction of the recording sheet P from the paper detection sensor 71 and the paper feeding roller 41. The second driving motor 92 is a driving source configured to supply the rotation driving force to the pairs of switch back rollers 341 and 342 and the pair of registration rollers 33. Further, the second driving motor 92 supplies the rotation driving force to the pair of fixing rollers including the heating roller 51 and the pressing roller 52 of the fixing section 5. The conveying section 3 includes the drive section 9, the pairs of conveying rollers 32, the paper feeding roller 41, the pairs of switch back rollers 341 and 342, the pair of registration rollers 33, and the like.

The drum motor 8 is a driving source configured to supply the rotation driving force to a rotating shaft (not illustrated) of the photosensitive drum 21.

The control section 100 controls the conveyance of the recording sheet P, the image formation, the fixing operation, and the determination of the paper jam (determination on whether the recording sheet P is jammed in the conveying path 31) when the image is formed on the recording sheet P.

First, the operation control at the time of forming the image in the image forming apparatus 1 will be described.

At the time of the image forming operation, the control section 100 controls the paper feeding roller 41 to pick up the recording sheets P housed in the paper feeding cassette 40 one by one and to feed the picked up recording sheet P to the main conveying path 311 and controls the pair of conveying rollers 32 disposed at each position of the main conveying path 311 to convey the recording sheet P to the image forming section 2. In the case of the continuous printing in which the image is continuously formed on a plurality of recording sheets P, the control section 100 controls the paper feeding roller 41 and the pairs of conveying rollers 32 to continuously convey the plurality of recording sheets P to the image forming section 2.

The control section 100 uses the timing at which the paper feeding roller 41 starts to convey the recording sheet P to the main conveying path 311 to control the image forming section 2 to start to form the toner image to be transferred onto the recording sheet P so that the toner image on the surface of the photosensitive drum 21 is transferred onto the recording sheet P after the predetermined time (defined based on the paper conveying speed by the paper feeding roller 41, the pairs of conveying rollers 32, and the pair of registration rollers 33 and the distance between the paper feeding mechanism 4 and the toner image transfer position N) elapses from the timing. In this case, the control section 100 drives the image forming section 2 including the drum motor 8 to start a series of processes of charging, exposing, developing, and transfer by each section of the image forming section 2 described above.

Further, the control section 100 uses the paper detection signal output by the resist sensor 78 disposed in the vicinity of the position where the pair of registration rollers 33 is disposed to control the pair of registration rollers 33 to adjust the timing at which the front edge of the recording sheet P reaches the toner image transfer position N of the image forming section 2 such that the timing at which the toner image formed by the image forming section 2 reaches the transfer position N matches the timing at which the recording sheet P reaches the transfer position N.

The control section 100 controls the transfer roller 25 to transfer the toner image on the surface of the photosensitive drum 21 onto the recording sheet P, which is conveyed, by the pairs of registration rollers 33, to the toner image transfer position N of the image forming section 2, that is, between the photosensitive drum 21 and the transfer roller 25. The toner images sequentially formed on the photosensitive drum 21 are sequentially transferred to respective recording sheets P continuously conveyed between the photosensitive drum 21 and the transfer roller 25.

The control section 100 controls to convey the recording sheet P on which an image has been formed by the image forming section 2 through the fixing section 5 and then allow the pairs of switch back rollers 341 and 342 to discharge the recording sheet P to the discharge tray 6. Further, when the double-sided printing is performed, the above-described reverse operation is performed by the pairs of switch back rollers 341 and 342, the recording sheet P is again conveyed from the reverse conveying path 312 to the toner image transfer position N of the image forming section 2, the image forming section 2 forms an image on the other surface of the recording sheet P, and then the recording sheet P is discharged to the discharge tray 6 by the pairs of switch back rollers 341 and 342.

Further, the control section 100 stops the drive section 9 when it is determined that paper is jammed during the image forming operation based on the detection signals output from the paper detection sensors 71 to 74 and stops operations associated with the conveying path 31 by each roller or pair of rollers described above.

Further, as described above, the control section 100 controls the conveying section 3 to convey the recording sheet P based on the sheet interval calculated by the sheet interval calculation section 101.

Further, the recording medium conveying apparatus according to the embodiment of the present disclosure includes, for example, the conveying path 31, the conveying section 3, the paper detection sensors 71, 72, and 75, the control section 100, the sheet interval calculation section 101, and the difference calculation section 102.

Hereinafter, the recording sheet conveying control at the time of the continuous printing in the image forming apparatus 1 will be described.

Figure 4:
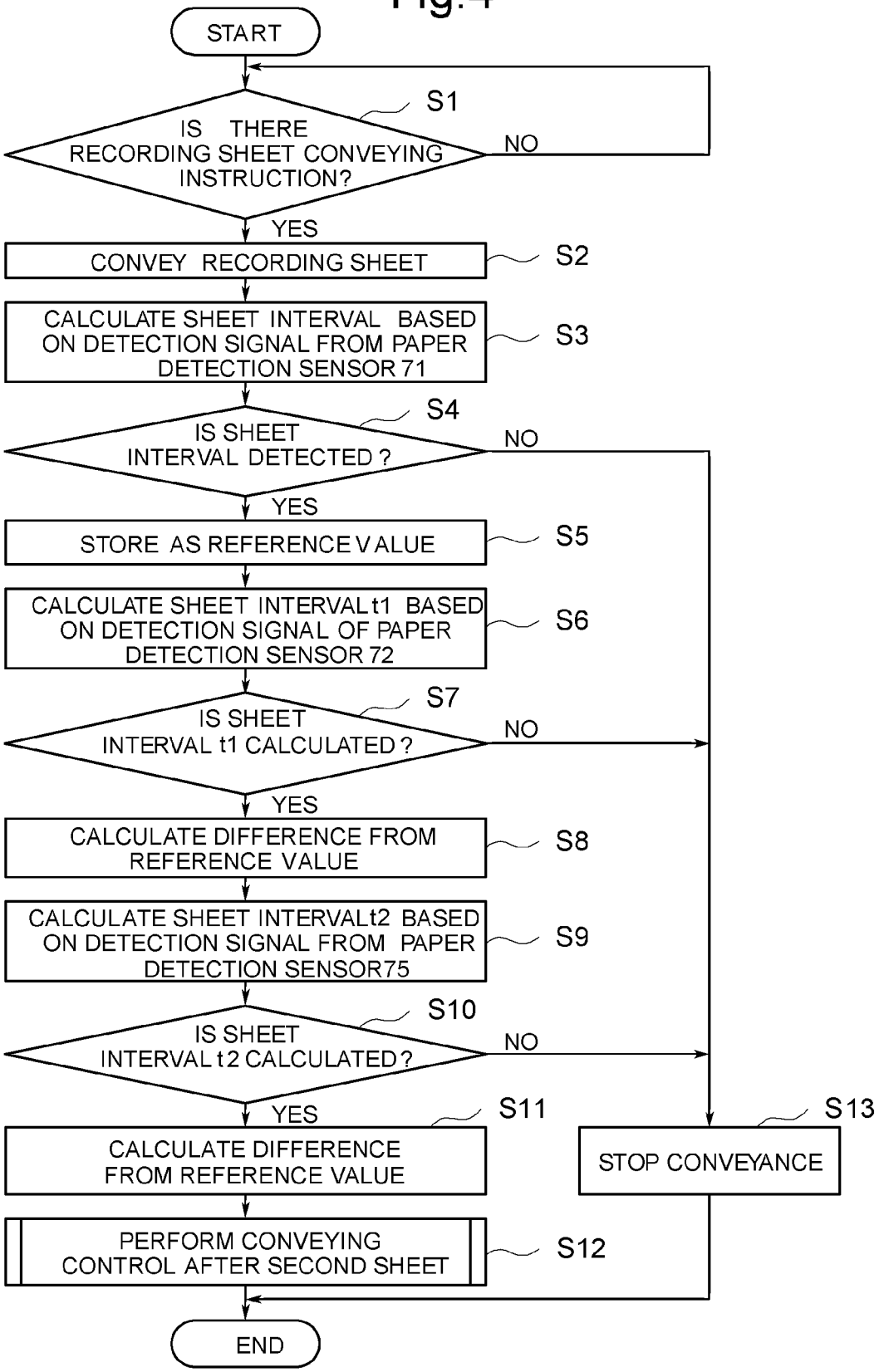
FIG. 4 is a flowchart showing a process of conveying first and second recording sheets at the time of continuous printing in the image forming apparatus.

First, the process of conveying the first and second recording sheets P at the time of the continuous printing will be described. FIG. 4 is a flowchart showing the process of conveying the first and second recording sheets at the time of the continuous printing in the image forming apparatus 1. FIGS. 5A to 5D are diagrams showing waveforms of the detection signals output from the paper detection sensors 71, 72, and 75.

When a printing job instructing the continuous printing is received from, for example, a computer connected to a network, and the like (YES in S1), the continuous printing is started by the control section 100. In this case, the control section 100 starts to control the paper feeding roller 41 and the pairs of conveying rollers 32 to continuously convey the plurality of recording sheets P to the image forming section 2 through the conveying path 31, as well as the pair of registration rollers 33, the pairs of switch back rollers 341 and 342, and the like to continuously convey the plurality of recording sheets P from the image forming section 2 to the discharge tray 6 (S2).

At the time of continuously conveying the recording sheet P, firstly, the detection signal from the paper detection sensor 71 used as the reference sensor among the paper detection sensors 71 to 77 is input to the control section 100 and the sheet interval calculation section 101.

Herein, the sheet interval calculation section 101 calculates the sheet interval between the first and second recording sheets based on the detection signal obtained from the paper detection sensor 71 (S3). The sheet interval calculation section 101 calculates the time from a variation point p1 to a variation point p2 as the sheet interval based on the variation point p1 at which the paper signal (H signal (on signal)) indicating that a first recording sheet P is present is changed to the no-paper signal (L signal (off signal)) indicating that the recording sheet P is absent and the variation point p2 at which the no-paper signal is changed to the paper signal indicating that a second recording sheet P is present, in the detection signal obtained from the paper detection sensor 71 illustrated in FIG. 5A, for example. That is, the variation point p1 represents that the rear edge of the first recording sheet P reaches the paper detection sensor 71 and the variation point p2 represents that the front edge of the second recording sheet P reaches the paper detection sensor 71.

Herein, when the sheet interval between the first and second recording sheets P may not be calculated by the sheet interval calculation section 101 as a value in the defined range (NO in S4), the control section 100 determines that recording sheet P is jammed and allows the conveying section 3 to stop the conveyance of the recording sheet P by the printing job (S13).

For example, in any one of (1) the case in which the paper signal representing that the front edge of the first recording sheet P has arrived is obtained from the paper detection sensor 71 and then the no-paper signal representing that the rear edge of the first recording sheet P has arrived is not obtained within a predetermined period of time, and (2) the case in which the no-paper signal representing that the rear edge of the first recording sheet P has arrived is obtained from the paper detection sensor 71 and then the paper signal representing that the front edge of the second recording sheet P has arrived is not obtained within the predetermined period of time, the control section 100 determines that recording sheets P is jammed and stops the conveyance of the recording sheet P based on the printing job.

Meanwhile, when the sheet interval calculation section 101 can calculates the sheet interval between the first and second recording sheets P as a value within the defined range (YES in S4), the sheet interval calculation section 101 stores the value of the sheet interval in a storage section such as a memory (not illustrated) as a reference value d0 (S5).

Further, when the detection signal from the paper detection sensor 72 is input to the control section 100 and the sheet interval calculation section 101, the sheet interval calculation section 101 calculates a sheet interval t1 between the first and second recording sheets based on the detection signal obtained from the paper detection sensor 72 (S6). The calculation of the sheet interval t1 is performed similar to S3, and the sheet interval calculation section 101 calculates a time from a variation point p3 representing the rear edge of the first recording sheet P to a variation point p4 representing the front edge of the second recording sheet P, as the sheet interval t1, in the detection signal obtained from the paper detection sensor 72 as illustrated in FIG. 5B.

Further, when the sheet interval t1 between the first and second recording sheets P is unable to be calculated by the sheet interval calculation section 101 as a value in the defined range (NO in S7), the control section 100 determines that recording sheet P is jammed and allows the conveying section 3 to stop the conveyance of the recording sheet P based on the printing job (S13).

Meanwhile, as described above, when the sheet interval calculation section 101 can calculate the sheet interval t1 between the first and second recording sheets P as the value in the defined range (YES in S7), the difference calculation section 102 calculates a difference d1 of the sheet interval t1 at the position where the paper detection sensor 72 is disposed calculated in S6 from the reference value d0 stored in S5 and stores the difference in the storage section (not illustrated) (S8).

Figure 5A:
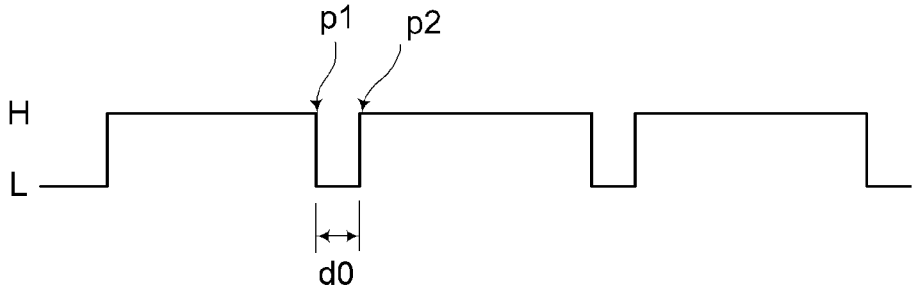
FIGS. 5A to 5D are diagrams showing waveforms of detection signals output from respective paper detection sensors.
Figure 5B:
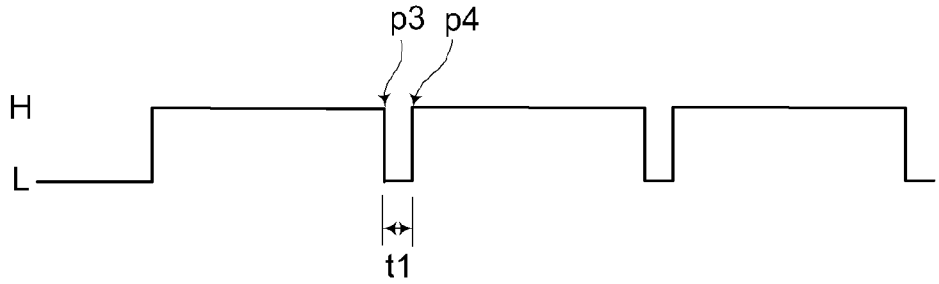

For example, as illustrated in FIG. 5A, in S3, the sheet interval calculation section 101 stores a sheet interval 100 (ms) as a reference value calculated based on the detection signal from the paper detection sensor 71 as the reference sensor as a reference value and as illustrated in FIG. 5B, in S6, when the sheet interval t1 calculated by the sheet interval calculation section 101 is 60 (ms), the difference calculation section 102 sets 40 (ms) as the difference d1 calculated by subtracting sheet interval (60 (ms)) from the reference value (100 (ms)). That is, the difference d1 is a detection precision difference (a performance difference) of the paper detection sensor 72 from the paper detection sensor 71 as the reference sensor.

Similarly, when the detection signal from the paper detection sensor 75 is input to the control section 100 and the sheet interval calculation section 101, the sheet interval calculation section 101 calculates a sheet interval t2 between the first and second recording sheets based on the detection signal obtained from the paper detection sensor 75 (S9). The sheet interval calculation section 101 calculates a time from a variation point p5 representing the rear edge of the first recording sheet P to a variation point p6 representing the front edge of the second recording sheet P, as the sheet interval t2, in the detection signal obtained from the paper detection sensor 75 as illustrated in FIG. 5C.

Herein, when the sheet interval t2 between the first and second recording sheets P is unable to be calculated by the sheet interval calculation section 101 as a value in the defined value (NO in S10), the control section 100 determines that the second recording sheet P is jammed and allows the conveying section 3 to stop the conveyance of the recording sheet P based on the printing job (S13).

Meanwhile, when the sheet interval calculation section 101 can calculate the sheet interval t2 between the first and second recording sheets P as the value in the defined range (YES in S10), the difference calculation section 102 calculates a difference d2 of the sheet interval t2 at the position where the paper detection sensor 75 is disposed, calculated in S9, from the reference value d0 stored in S5 and stores the difference in the storage section (not illustrated) (S11).

Figure 5C:
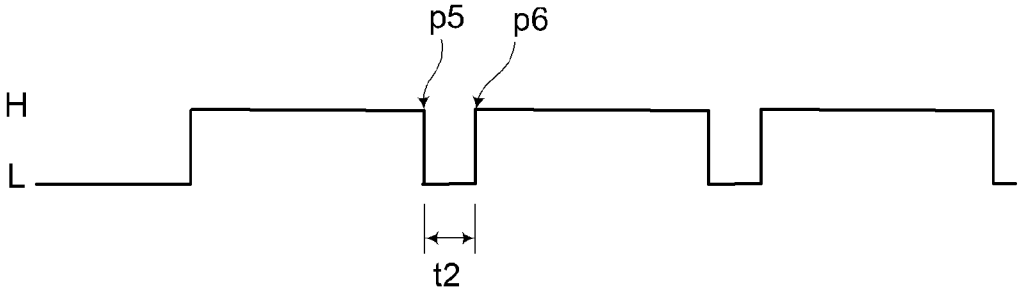
Figure 5D:
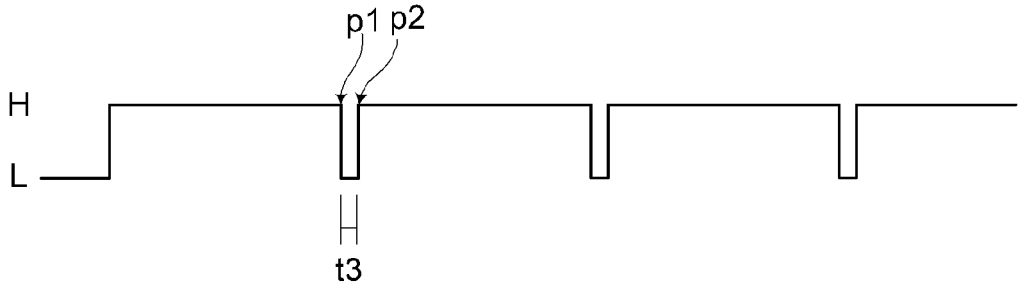

For example, as illustrated in FIG. 5C, in S9, when the sheet interval t2 calculated by the sheet interval calculation section 101 is 120 (ms), the difference calculation section 102 sets −20 (ms) as the difference d2 calculated by subtracting the sheet interval (120 (ms)) from the reference value (100 (ms)). The difference d2 is the detection precision difference (the performance difference) of the paper detection sensor 75 to the paper detection sensor 71 as the reference sensor.

Figure 6:
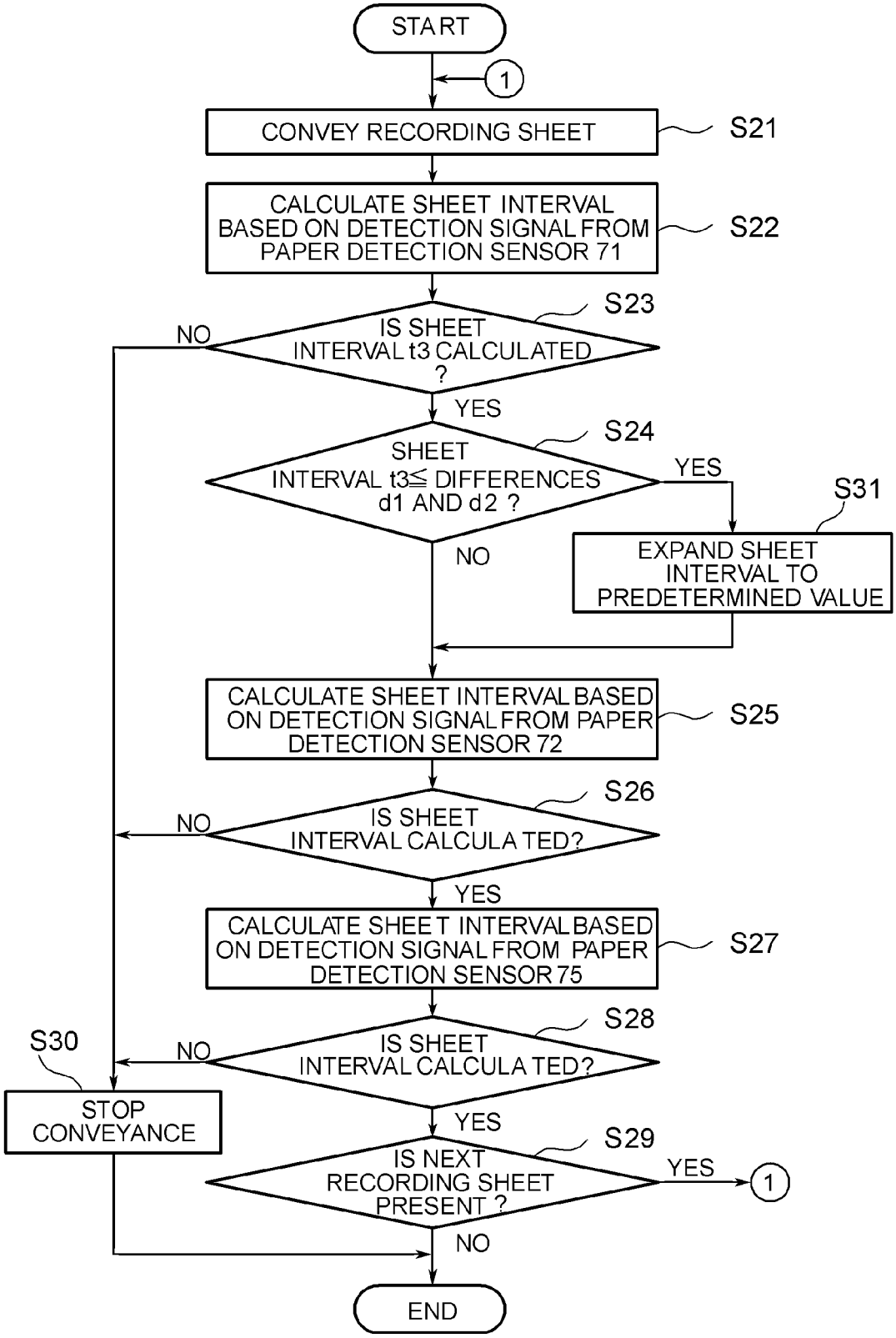
FIG. 6 is a flowchart showing a process of controlling a conveyance of recording sheets after the second recording sheet at the time of the continuous printing in the image forming apparatus.

After the difference d2 in S11 is calculated, the process proceeds to a process (S12) after the second sheet shown in FIG. 6 to be described later.

The difference d1 and the difference d2 obtained as described above are used to control the conveyance of the recording sheet P from the second sheet onwards to be described later.

Next, the recording sheet conveying control from the second sheet onwards at the time of the continuous printing in the image forming apparatus 1 will be described. FIG. 6 is a flowchart showing a process of controlling a conveyance of recording sheets from the second sheet onwards at the time of the continuous printing in the image forming apparatus 1.

Based on the printing job, the control section 100 allows the conveying section 3 to convey a third recording sheet P, subsequent to the conveyance of the first and second recording sheets P (S21).

Further, when the detection signal from the paper detection sensor 71 serving as the reference sensor is input to the control section 100 and the sheet interval calculation section 101, the sheet interval calculation section 101 calculates a sheet interval between the second and third recording sheets t3 based on the detection signal obtained from the paper detection sensor 71 (S22). The calculation of the sheet interval t3 by the sheet interval calculation section 101 is performed similarly to calculation of the sheet interval between the first and second recording sheets P.

Herein, when the sheet interval t3 between the second and third recording sheets P is unable to be calculated by the sheet interval calculation section 101 as a value in the defined range (NO in S23), the control section 100 determines that the third recording sheet P is jammed and allows the conveying section 3 to stop the conveyance of the recording sheet P based on the printing job (S30). The determination that the third recording sheet P is jammed by the sheet interval calculation section 101 is performed similarly to the determination that the first or second recording sheet P is jammed.

Meanwhile, when the sheet interval calculation section 101 calculates the sheet interval t3 between the second and third recording sheets P as a value of a defined range (YES in S23), the control section 100 determines whether the sheet interval t3 is a value equal to or less than the calculated differences d1 and d2 (S24). That is, the control section 100 determines whether the condition that the sheet interval t3 is equal to the difference d1 or fewer and the condition that the sheet interval t3 is equal to the difference d2 or fewer are satisfied.

For example, as described above, when the difference d1 is 40 (ms) and the difference d2 is −20 (ms), if the sheet interval t3 (FIG. 5D) calculated by the sheet interval calculation section 101 in S22 is 40 (ms), since the sheet interval t3 (40 (ms)) is equal to the difference d1 (40 (ms)), the control section 100 determines that the condition that the sheet interval t3 is equal to the difference d1 or fewer is satisfied. Further, the control section 100 determines that the condition that the sheet interval t3 is equal to the difference d2 or fewer is not satisfied since the sheet interval t3 (40 (ms)) is larger than the difference d2 (−20 (ms)).

Herein, when it is determined that any one of the condition that the sheet interval t3 is equal to the difference d1 or fewer and the condition that the sheet interval t3 is equal to the difference d2 or fewer is satisfied (YES in S24), the control section 100 controls the conveying section 3 to extend the sheet interval between the rear edge of the second recording sheet P and the front edge of a third recording sheet P by a predetermined value (S31).

For example, when, as described above, the sheet interval t3 is 40 (ms) and the difference d1 at the paper detection sensor 72 is 40 (ms), the actual sheet interval between the second and third recording sheets P at the position of the paper detection sensor 71 will be shifted 60 (ms) from a reference value 100 (ms) in a direction of reduction of the sheet interval. In this case, however, the paper detection sensor 72 outputs, to the control section 100 and the sheet interval calculation section 101, a detection signal representing a sheet interval smaller than the actual sheet interval at the paper detection sensor 71 by 40 (ms) corresponding to the difference d1, i.e., a sheet interval of 0 (ms), and therefore cannot output a detection signal accurately representing the actual sheet interval. Then, if the control section 100 determined whether or not the third recording sheet P was jammed based on the detection signal, it would determine that the third recording sheet P was jammed on the grounds that this applied to the above case (1) and allow the conveying section 3 to stop the conveyance of the recording sheet P. Therefore, the control section 100 performs the aforementioned process of extending the sheet interval (S31) to prevent the third recording sheet P from being determined to be jammed based on the detection signal output from the paper detection sensor 72 and prevent the conveyance of the recording sheet P from being stopped. Only if the condition that the sheet interval t3 is bigger to difference d1 is satisfied, the paper detection sensor 72 can output a detection signal accurately representing the sheet interval. Further, the same as described herein applies to the paper detection sensor 75.

In other words, according to the control, the continuous conveyance of the recording sheet P by the conveying section 3 is performed by the control section 100 until the condition that the sheet interval t3 is equal to difference d1 or fewer or the condition that the sheet interval t3 is equal to difference d2 or fewer is satisfied. That is, even though the sheet interval between the recording sheets P is narrow, the control section 100 allows the conveying section 3 to continuously convey the recording sheets P as long as the sheet interval can be calculated within the detection capability range of the paper detection sensors 72 and 75.

Further, the control section 100 uses, for example, a value at least exceeding the larger one of the calculated differences d1 and d2 as a predetermined value to perform the process of extending the sheet interval of S31. Alternately, the control section 100 uses a value, as the predetermined value, exceeding any one of the calculated differences d1 and d2, which is smaller than the sheet interval t3. By this, it is possible to smoothly perform the continuous conveyance of the recording sheet P while accurately avoiding the situation of determining that paper is jammed.

Meanwhile, when both of the condition that the sheet interval t3 is equal to difference d1 or fewer and the condition that the sheet interval t3 is equal to difference d2 or fewer are not satisfied (NO in S24), the control section 100 performs, similar to the sheet interval calculation at the time of the conveying control of the recording sheet P shown in FIG. 4, the sheet interval calculation of the rear edge of the second recording sheet P and the front edge of the third recording sheet P and performs the determination of the jam based on the detection signal output from the paper detection sensor 72 (S25 and S26). When it is determined that the third recording sheet P is jammed (NO in S26), the control section 100 controls the conveying section 3 to stop the conveyance of the recording sheet P based on the printing job (S30).

In the sheet interval calculation of the rear edge of the second recording sheet P and the front edge of the third recording sheet P and the determination of a paper jam based on the detection signal output from the paper detection sensor 72, when it is determined that the third recording sheet P is not jammed (YES in S26), the control section 100 further performs the sheet interval calculation of the rear edge of the second recording sheet P and the front edge of the third recording sheet P and the determination of a paper jam based on the detection signal output from the paper detection sensor 75 (S27 and S28). When it is determined that the third recording sheet P is jammed (NO in S28), the control section 100 controls the conveying section 3 to stop the conveyance of the recording sheet P based on the printing job (S30).

In the sheet interval calculation and the determination of a paper jam based on the detection signal output from the paper detection sensor 75, when the control section 100 determines that the third recording sheet P is not jammed (YES in S28), the control section 100 determines whether the recording sheet P to be conveyed subsequently is present based on the printing job (S29) and when the recording sheet P to conveyed subsequently is present (YES in S29), the process returns to S21 and processes from S22 onwards are repeatedly performed on the sheet interval from the rear edge of the third recording sheet P to the front edge of a fourth recording sheet P.

Further, when the control section 100 determines that the recording sheet P to be conveyed subsequently is not present (NO in S29), the process ends.

By this, according to the conveying control of the recording sheet at the time of the above-described continuous printing, in order to prevent misdetection due to performance deviations and the like, which are caused by factors such as a shape of each paper detection sensor 71, 72, and 75, as in the related art, a threshold value used to determine whether the sheet interval is extended should not be set to a value equal to or more than the sheet interval which may be detected by all the paper detection sensors 71, 72, and 75. The conveying control of the recording sheet may convey recording sheets P even in the state in which the sheet interval is narrower, as long as the sheet interval which may be detected by each paper detection sensor 71, 72, and 75 is maintained. As a result, in the conveying control of the recording sheet P at the time of the continuous printing, needless control in which the conveying section 3 extends the sheet interval even though the recording sheet P could actually be conveyed at the shorter sheet interval by obtaining the accurate detection signal from each paper detection sensor, which is a problem of the related art, may not be performed.

For example, in the general image forming apparatus, each recording sheet detection sensor sets an interval from the detection signal representing the rear edge of the recording sheet conveyed first to the detection signal representing the front edge of the next recording sheet subsequently conveyed as the sheet interval of each recording sheet. However, a detection consumption time required for detecting the front edge of the next recording sheet after detecting the rear edge of the previous recording sheet may be different depending on each recording sheet detection sensor due to the performance deviations which are caused by the shapes of each recording sheet detection sensor and the like. In consideration of this, in the general image forming apparatus, in order to prevent an erroneous detection signal from being output from each recording sheet detection sensor, the defined interval is set to be an interval exceeding the detection consumption time by all the recording sheet detection sensors. In this case, actually, even though the recording sheet may be conveyed at an even shorter sheet interval by obtaining the accurate detection signal from each recording sheet detection sensor, when the sheet interval is the defined interval or less, the control section controls the driving of the conveying section to expand the sheet interval up to the defined interval. Therefore, the above control is wasteful and the sheet interval set larger than necessary causes a reduced number of sheets printed per unit time during continuous printing.

In this respect, according to the paper conveying mechanism 3 according to this embodiment, the wasteful control can be prevented and the speed of continuously conveying the recording sheet P can be increased without degrading the detection precision of the sheet interval of each continuously conveyed recording sheet interval.

Further, the present disclosure is not limited to the configuration of the foregoing embodiments and therefore includes various modifications. For example, although a printer is described as an example of the image forming apparatus in each embodiment according to the present disclosure, this is merely an example, and therefore other image forming apparatuses such as a multifunctional peripheral, a copier, a facsimile device, and the like may be used.

Further, the configuration and process illustrated in the embodiments with reference to FIGS. 1 to 6 are merely embodiments of the present disclosure and the present disclosure is not limited to these configurations and processes.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. A recording medium conveying apparatus, comprising:

a conveying path through which a recording medium is conveyed;

a conveying section configured to continuously convey the plurality of recording media through the conveying path, a plurality of recording medium detection sensors disposed in the conveying path at different positions in a conveying direction of the recording medium to detect the recording media at each of the positions where the recording medium detection sensors are disposed;

a medium interval calculation section configured to calculate, for each recording medium detection sensor, a medium interval in the conveying direction of recording media continuously conveyed through the conveying path by the conveying section based on respective outputs from the plurality of recording medium detection sensors;

a control section configured to control the conveyance of the recording medium by the conveying section based on the medium interval calculated for each recording medium detection sensor by the medium interval calculation section; and a difference calculation section configured to set the medium interval calculated by the medium interval calculation section based on an output from the recording medium detection sensor serving as a reference sensor among the plurality of recording medium detection sensors to a reference value and calculate at a predetermined time a difference by subtracting a medium interval calculated by the medium interval calculation section based on an output from each of the other recording medium detection sensors from the reference value, wherein when, during the continuous conveyance of the recording media by the conveying section, a value obtained by subtracting the difference calculated by the difference calculation section from the medium interval between recording media calculated by the medium interval calculation section based on the output from the reference sensor is equal to or less than zero, the control section controls the conveying section to convey each recording medium by extending the medium interval by a predetermined value.

2. The recording medium conveying apparatus according to claim 1, wherein the medium interval calculation section calculates the medium interval serving as the reference value every time a printing job is performed and, the difference calculation section uses the reference value calculated for the printing job during the execution to calculate the difference every time the printing job is performed.

3. The recording medium conveying apparatus according to claim 1, wherein the medium interval calculation section sets a value of the medium interval as the reference value when the medium interval is calculated as the value within a defined range.

4. The recording medium conveying apparatus according to claim 1, wherein the control section performs conveying control of the conveying section based on a comparison between the difference and the reference value when the medium interval is calculated as a value within a defined range by the medium interval calculation section during the continuous conveying of the recording media by the conveying section.

5. The recording medium conveying apparatus according to claim 1, wherein the control section uses a value larger than the difference which is lower than the medium interval calculated by the medium interval calculation section among the calculated differences as the predetermined value when performing conveying control of the conveying section based on a comparison between the difference and the reference value during the continuous conveying of the recording media by the conveying section.

6. The recording medium conveying apparatus according to claim 1, wherein the difference calculation section uses the recording medium detection sensor disposed at a most upstream position in the conveying direction of the recording medium as the reference sensor to calculate the difference.

7. An image forming apparatus comprising:

the recording medium conveying apparatus according to claim 1; and an image forming section configured to form an image on a recording medium conveyed on the conveying path by the conveying section.

* * * * *